US007293538B2

(12) United States Patent
Hayman et al.

(10) Patent No.: US 7,293,538 B2
(45) Date of Patent: Nov. 13, 2007

(54) OVERHEAD CAMSHAFT DRIVE ASSEMBLY

(75) Inventors: Alan W. Hayman, Romeo, MI (US); James J. Mazzola, III, Dryden, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/918,615

(22) Filed: Aug. 13, 2004

(65) Prior Publication Data

US 2006/0032469 A1 Feb. 16, 2006

(51) Int. Cl.
*F01L 1/02* (2006.01)

(52) U.S. Cl. ..... 123/90.31; 123/90.15; 123/90.27

(58) Field of Classification Search ..... 123/90.15, 123/90.16, 90.17, 90.18, 90.27, 90.31, 193.3, 123/198 F, 193.5, 193.4, 90.6; 464/1, 2, 464/160

See application file for complete search history.

(56) References Cited

U.S. PATENT DOCUMENTS

RE24,645 E * 5/1959 Chayne ..... 123/54.7
5,033,327 A * 7/1991 Lichti et al. ..... 74/568 R
5,113,807 A * 5/1992 Kobayashi ..... 123/41.74
5,560,329 A * 10/1996 Hayman ..... 123/90.31
5,564,380 A * 10/1996 Kobayashi et al. ..... 123/192.2
6,367,435 B1 * 4/2002 Okui et al. ..... 123/90.15
2004/0154568 A1 * 8/2004 Yamauchi et al.

FOREIGN PATENT DOCUMENTS

DE 3619577 A * 12/1987

* cited by examiner

*Primary Examiner*—Ching Chang

(57) ABSTRACT

A variable timing camshaft drive assembly for an internal combustion engine utilizes a single cam phaser, driven by an engine crankshaft, capable of operating multiple camshafts carried on multiple banks of an engine. The cam phaser is carried on a hub extending from a mounting member attached to an engine block. The cam phaser includes an input sprocket and an output sprocket separated by a phasing device capable of altering the phase angle of the sprockets relative to one another. A first timing chain connects a drive sprocket of the crankshaft with the input sprocket of the cam phaser and a second timing chain connects the output sprocket of the cam phaser with the driven sprockets of the camshafts. As the phasing device alters the phase angle between the input and output sprockets, the phase angle between the camshafts and the crankshafts is altered.

10 Claims, 2 Drawing Sheets

OVERHEAD CAMSHAFT DRIVE ASSEMBLY

TECHNICAL FIELD

This invention relates to a variable timing camshaft drive for an internal combustion engine and, more particularly, to a variable camshaft drive having a remote mounted compound cam phaser driven by a crankshaft and operable to vary the phase angle of multiple camshafts relative to the crankshaft.

BACKGROUND OF THE INVENTION

Internal combustion engines commonly employ rotatable camshafts, driven by an engine crankshaft, to operate engine intake and exhaust valves of the engine. These camshafts may operate with fixed timing relative to the crankshaft or may be operated with a phasing device capable of altering the phase angle of the camshafts relative to the crankshaft.

Such phasing devices are commonly attached coaxially at an end of an associated camshaft to phase the associated camshaft or a pair of camshafts on a single cylinder bank. However, adding a cam phaser to a camshaft increases its length and may require cylinder head modifications to accommodate the lengthened camshaft. In addition, engines having multiple cylinder banks, require multiple cam phasers, one phaser for each bank, which increases engine cost and complexity.

SUMMARY OF THE INVENTION

The present invention provides a variable timing camshaft drive assembly for an internal combustion engine utilizing a single remote cam phaser rotatable on a fixed mounting member and capable of operating multiple camshafts carried on multiple banks of an engine.

The drive includes an engine crankshaft having a drive sprocket disposed at one end of the crankshaft. The drive sprocket engages a timing chain engaging an input sprocket of a remotely mounted compound cam phaser. The input sprocket of the cam phaser drives an output sprocket, which drives a second chain, engaging at least one driven sprocket disposed at a front end of an overhead camshaft. If desired, the second chain may be adapted to engage multiple driven sprockets of multiple camshafts on multiple cylinder banks of the engine.

The cam phaser is carried by a hub extending from a fixed mounting member adapted for attachment to an engine block. The mounting member allows the cam phaser to be remotely mounted on various locations of an engine block to provide mounting versatility for various engine sizes and configurations.

During operation, the phasing device operates to selectively alter the phase angle between the input sprocket and the output sprocket to vary the phase angle of the camshafts relative to the crankshaft.

These and other features and advantages of the invention will be more fully understood from the following description of certain specific embodiments of the invention taken together with the accompanying drawings.

DESCRIPTION OF THE PREFERRED EMBODIMENT

Figure 1:
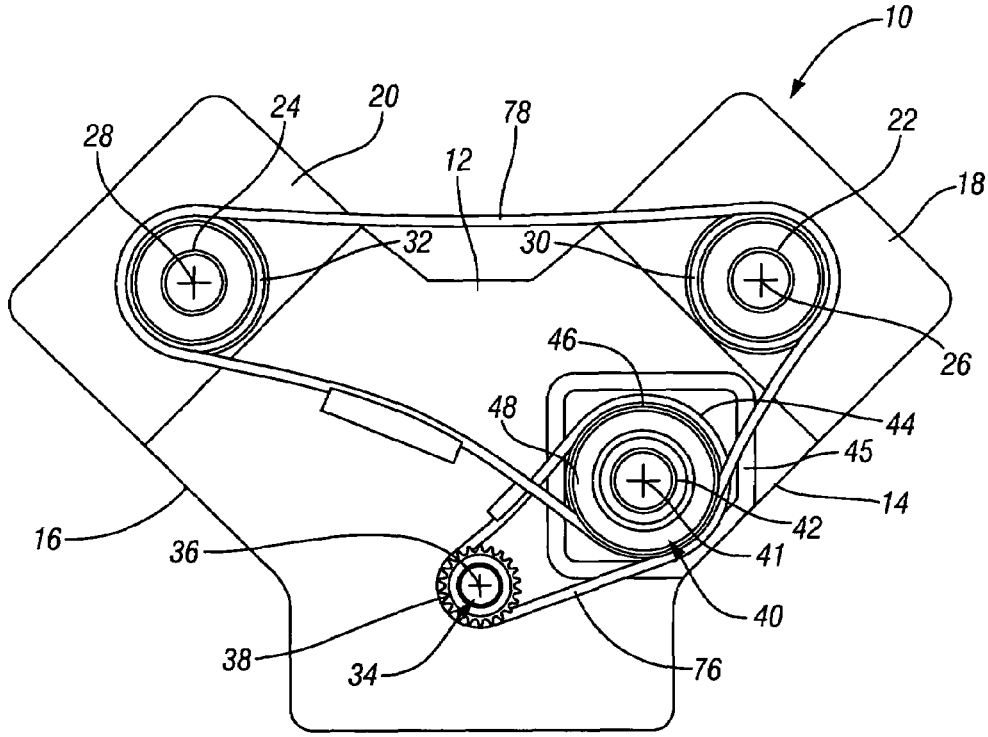
FIG. 1 is a diagrammatic view of a camshaft drive for a V-type internal combustion engine according to a preferred embodiment of the present invention.

Referring first to FIG. 1 of the drawings in detail, numeral 10 generally indicates an exemplary variable timing camshaft drive for an internal combustion engine, having a V-type block 12 with first and second cylinders banks 14, 16, each carrying a cylinder head 18, 20. Each cylinder head 18, 20 carries at least one overhead camshaft 22, 24, each rotatable on an axis 26, 28, for operating intake and/or exhaust valves, not shown. Each camshaft 22, 24 is provided with a driven sprocket 30, 32 mounted on ends of the camshafts. A crankshaft 34, rotatable on an axis 36, is carried in the block 12. The crankshaft 34 is provided with a drive sprocket 38 mounted on an end of the crankshaft.

Figure 2:
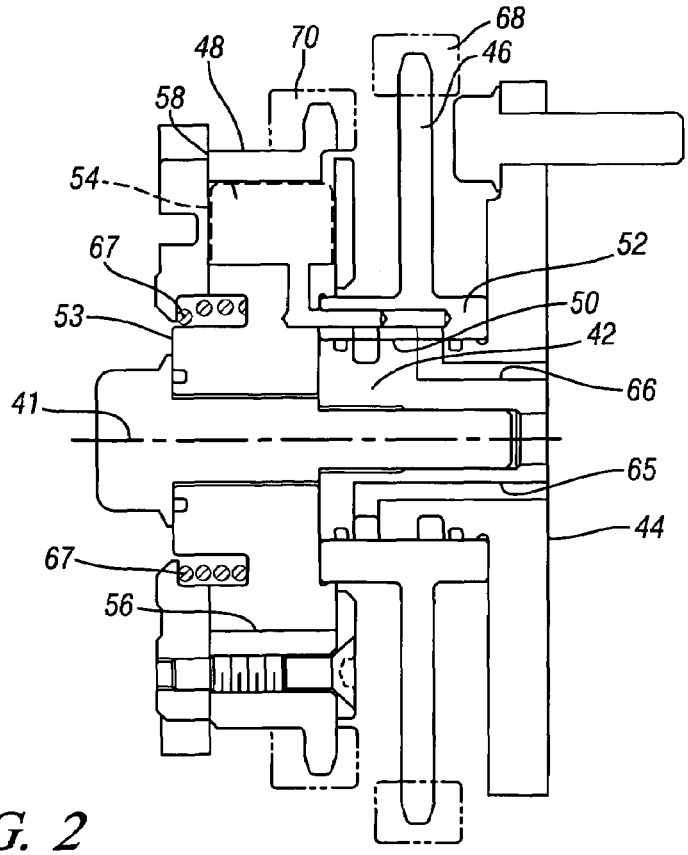
FIG. 2 is a longitudinal cross-sectional view through the compound cam phaser of FIG. 1.

Referring now to FIGS. 1 and 2, a single remotely mounted cam phaser 40, rotatable on an axis 41, is carried on a stationary hub 42 extending from a mounting member 44 fastened to the block 12 intermediate the camshafts 22, 24 and the crankshaft 34. The mounting member 44 is adapted to be attached to various mounting locations of various engine blocks to provide maximum mounting versatility of the cam phaser 40. Alternatively, the mounting member 44 may be welded or cast into the cylinder block 12. If desired, the cam phaser 40 may be mounted on a cylinder block offset, such as recessed face 45, to reduce the overhang length of the camshafts 22, 24 and the crankshaft 34 from the engine.

In the embodiment of FIG. 1, the single cam phaser 40 is carried on the stationary hub 42 extending from the mounting member 44 fixed on the offset face (recessed face 45) of the engine cylinder block 12 so that the extension of the drive sprocket 38 and the driven sprockets 30, 32 from the front of the engine can be minimized. Where the single cam phaser 40 is the only cam phaser included in the camshaft drive of this embodiment, it is exclusively operative to contemporaneously vary the phase angles relative to the crankshaft 34 of both the first and second camshafts 22, 24 carried by the first and second cylinder banks 14, 16, respectively. Also, where the first and second camshafts 22, 24 are adapted to operate both intake and exhaust valves of their respective cylinder banks 14, 16, the single cam phaser 40, through the first and second camshafts 22, 24, is also effective to contemporaneously vary the timing of intake and exhaust valves in both cylinder banks 14, 16 of the engine.

Figure 3:
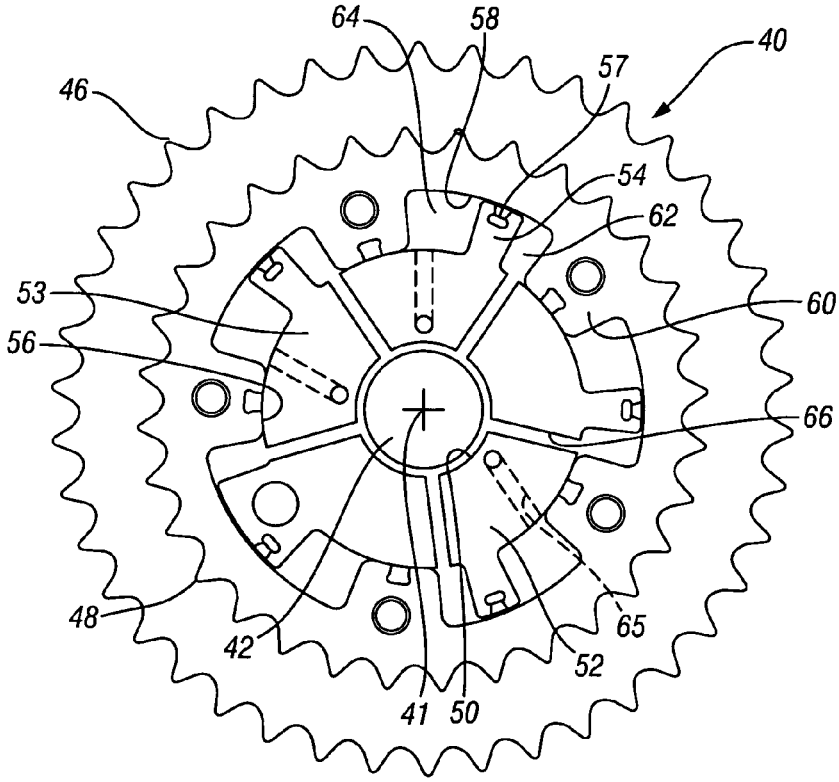
FIG. 3 is a transverse cross-sectional view through the cam phaser of FIG. 2.

In an exemplary embodiment, as shown in FIGS. 2 and 3, the cam phaser 40 is provided with axially spaced input and output sprockets 46, 48, which translate motion from the crankshaft 34 to the camshafts 22, 24. The input sprocket 46 has a central bore 50 rotatable on the hub 42 and surrounded by a cylindrical flange 52 of input sprocket 46. A rotor 53 is fixed to the flange 52 and provided with a plurality of radially extending vanes 54. The output sprocket 48 has a central opening 56 adapted to be carried upon the rotor 53. The central opening 56 of the output sprocket 48 includes a plurality of radially extending chambers 58 separated by a plurality of radially extending lands 60.

When assembled, the radially extending vanes 54 of the rotor 53 subdivide the chambers 58 of the output sprocket 46 to form advance and retard chambers 62, 64. If desired, each vane 54 may be provided with a longitudinal seal 57 to improve the hydraulic separation between the chambers. Advance and retard oil passages 65, 66 are provided through the mounting member 44, the hub 42 the flange 52 and the rotor 53 to deliver pressurized oil to opposite sides of each vane in each chamber 62, 64. If desired, seals or covers may be provided between the input and output sprockets, as needed, to prevent the leakage of pressurized oil from the oil passages 65, 66 and the chambers 62, 64.

In addition, the cam phaser 40 may be installed with a biasing device such as a spring 67 operable to return the input and output sprockets 46, 48 to a predetermined relationship when the engine is shut down.

Figure 4:
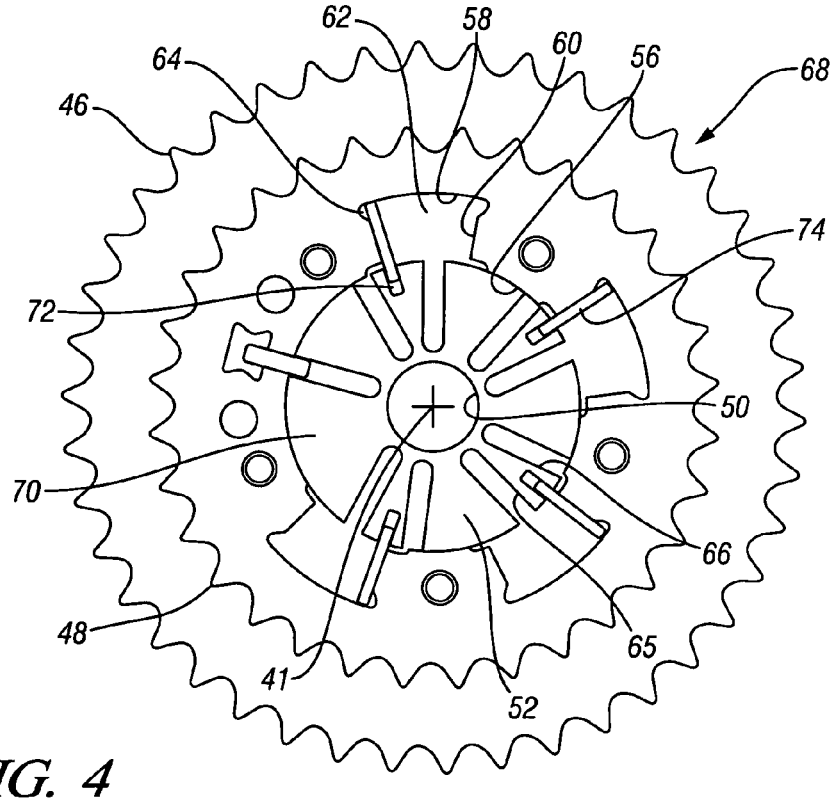
FIG. 4 is a view similar to FIG. 3 showing an alternative cam phaser arrangement.

FIG. 4 shows another embodiment of a cam phaser 68, similar to the cam phaser 40 of FIGS. 2 and 3, where like numbers indicate like parts. The cam phaser 68 is provided with axially spaced input and output sprockets 46, 48, which translate motion from the crankshaft 34 to the camshafts 22, 24. The input sprocket 46 has a central bore 50 rotatable on the hub 42 and surrounded by a cylindrical flange 52 of input sprocket 46. A rotor 70 is fixed to the flange 52 and provided with a plurality of radially slots 72 carrying radially extendable vanes 74. The output sprocket 48 has a central opening 56 adapted to be carried upon the rotor 70. The central opening 56 of the output sprocket 48 includes a plurality of radially extending chambers 58 separated by a plurality of radially extending lands 60.

When assembled, the vanes 74 of the rotor 70 subdivide the chambers 58 of the output sprocket 46 to form advance and retard chambers 62, 64. Oil passages 65, 66 are provided through the mounting member 44, the hub 42 the flange 52 and the rotor 53 to deliver pressurized oil to opposite sides of each vane in each chamber 62, 64. If desired, seals or covers may be provided between the input and output sprockets, as needed, to prevent the leakage of pressurized oil from the oil passages 65, 66 and the chambers 62, 64.

The drive sprocket 38 of the crankshaft 34 engages and drives the input sprocket 46 of the cam phaser 40 via a first timing chain 76. As the input sprocket 46 is rotated, the motion of the input sprocket is transferred through the cam phaser 40 to the output sprocket 48, which in turn drives a second timing chain 78 that engages and drives the driven sprockets 30, 32 of the camshafts 22, 24. The chains 54, 56 may be conventional silent type chains, roller chains, or a belts made of fiber reinforced electrometric materials or other types of generally inextensible drive elements known to those skilled in the art.

In operation, the crankshaft 34 rotates within the block 12. The rotation of the crankshaft 34 drives the first chain 54 which rotates the input sprocket 46 of the cam phaser 40. The rotation of the input sprocket 46 drives the output sprocket 48 in a desired phase relationship. As the output sprocket 48 rotates it drives the second chain 56 which rotates the driven sprockets 30, 32 and the camshafts 22, 24 within the heads 18, 20.

Sensors, not shown, monitor the angular relationship between the camshafts 22, 24 and the crankshaft 34 and relay the angular relationship to an engine control module (ECM), not shown. The ECM determines, moment by moment, the optimal crank/cam phase relationship. As the optimal crank/cam phase relationship is calculated, the ECM sends a signal to an oil control solenoid, not shown, which directs pressurized oil through the oil passages 65, 66 to the chambers 58 of the cam phaser 40.

As needed, variable oil pressure is selectively delivered into the advance and retard chambers 62, 64 of the cam phasing device 40, to alter the phase angle between the input sprocket and the output sprockets 46, 48. As the pressurized oil is delivered to the advance chamber 62, the oil urges the vanes 54 into the retard chambers 64. This causes the phase angle between the input and output sprockets 46, 48 to increase and thereby advance the camshafts 22, 24 relative to the crankshaft 34. When oil is directed to the retard chambers 64, the phase angle between the input and output sprockets 46, 48 decreases, thereby retarding the phase angle between the camshafts 22, 24 relative to the crankshaft 34. When the engine is stopped, oil pressure supplied to the chambers 58 is reduced allowing the spring 67 to return the cam phaser 40 to a predetermined phase relationship for restarting the engine.

In operation, the cam phaser 68 operates similarly to cam phaser 40 of FIGS. 2 and 3, in that the chambers 62, 62 of the cam phaser 68 receive pressurized oil to alter the phase angle between the input and output sprockets 46, 48 to alter the phase angle between the driven sprockets 30, 31 and the drive sprocket 38.

The above-described embodiments are directed to a V-type engine. However, it should be understood that the cam phasers 40, 68 may be applied to other engine configurations such as an inline engine having one cylinder bank.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A camshaft drive for an internal combustion engine, the drive comprising:

a drive sprocket connectable with a crankshaft rotatable on a first axis;

a driven sprocket connectable with a camshaft rotatable on a second axis spaced from the first axis;

an input sprocket and an output sprocket rotatable on a third common axis, spaced from the first and second axes, and connected with a cam phaser operable to vary the phase angle between the input and output sprockets; and a first chain connecting the drive sprocket with the input sprocket and a second chain connecting the output sprocket with the driven sprocket whereby the cam phaser is operable to vary the phase angle between the drive and the driven sprockets;

wherein the cam phaser is carried on a stationary hub extending from a mounting member fixed on an offset face of an engine block so that the extension of the drive and the driven sprockets from the front of the engine can be minimized.

2. A camshaft drive as in claim 1 including oil passages adapted to conduct pressurized oil from the engine block through the mounting member to the cam phaser.

3. A camshaft drive as in claim 1 including a second driven sprocket connectable with a second camshaft rotatable on a fourth axis spaced from the first, second and third axes.

4. A camshaft drive for a V-type internal combustion engine having first and second cylinder banks, the drive comprising:

a drive sprocket connectable with a crankshaft rotatable on a first axis;

a first driven sprocket connectable with a first camshaft carried by the first cylinder bank and rotatable on a second axis spaced from the first axis;

a second driven sprocket connectable with a second camshaft carried by the second cylinder bank and rotatable on a third axis spaced from the first and second axes;

an input sprocket and an output sprocket rotatable on a fourth common axis spaced from the other named axes and connected with a single cam phaser operable to vary the phase angle between the input and output sprockets; and a first chain connecting the drive sprocket with the input sprocket and a second chain connecting the output sprocket with the first and second driven sprockets whereby the single cam phaser is operable to vary the phase angle between the drive and the driven sprockets; and wherein said single cam phaser is the only cam phaser included in the camshaft drive and is exclusively operative to contemporaneously vary the phase angles relative to the crankshaft of both the first and second camshafts carried by the first and second cylinder banks, respectively.

5. A camshaft drive as in claim 4 wherein both the first and second camshafts are adapted to operate both intake and exhaust valves of their respective cylinder banks whereby the single cam phaser through the first and second camshafts is effective to contemporaneously vary timing of the intake and exhaust valves in both cylinder banks of the engine.

6. A cam phasing device for altering the phase angle of at least one camshaft relative to a crankshaft in an internal combustion engine, the device comprising:

a mounting member adapted to be mountably fixed to an engine block and having an axially extending stationary hub;

a pair of rotatable sprockets supported by the hub; and a phasing device operable to alter the phase angle of the sprockets relative to one another.

7. A cam phasing device as in claim 6 wherein the phasing device is hydraulically actuated.

8. A cam phasing device as in claim 6 wherein the phasing device receives pressurized oil from the engine through the mounting member.

9. A cam phasing device as in claim 6 wherein one of said pair of sprockets is drivably connected to a drive sprocket mounted on said crankshaft and another of said pair of sprockets is drivably connected with at least one driven sprocket mounted on said at least one camshaft.

10. A cam phasing device as in claim 9 wherein said at least one camshaft is adapted for operating both intake and exhaust valves of a cylinder bank of the engine.

* * * * *